US010453378B2

(12) United States Patent
Ding et al.

(10) Patent No.: US 10,453,378 B2
(45) Date of Patent: Oct. 22, 2019

(54) REGULATING METHOD AND REGULATING APPARATUS FOR A DRIVING VOLTAGE OF A DISPLAY MODULE

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Jinbo Ding, Beijing (CN); Ying Zhang, Beijing (CN); Xin Li, Beijing (CN); Dawei Li, Beijing (CN); Changjiang Wang, Beijing (CN); Xuchen Yuan, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 589 days.

(21) Appl. No.: 15/099,090

(22) Filed: Apr. 14, 2016

(65) Prior Publication Data

US 2016/0365025 A1 Dec. 15, 2016

(30) Foreign Application Priority Data

Jun. 11, 2015 (CN) ..... 2015 1 0319899

(51) Int. Cl.

| | |
|---|---|
| ***G09G 3/20*** | (2006.01) |
| ***G09G 3/00*** | (2006.01) |
| ***G09G 3/36*** | (2006.01) |

(52) U.S. Cl.

CPC ..... *G09G 3/2092* (2013.01); *G09G 3/006* (2013.01); *G09G 3/3648* (2013.01); *G09G 2320/0673* (2013.01); *G09G 2320/0686* (2013.01)

(58) Field of Classification Search

CPC .... G09G 3/2092; G09G 3/006; G09G 3/3648; G09G 2320/0673; G09G 2320/0686

See application file for complete search history.

(56) References Cited

U.S. PATENT DOCUMENTS

| | | | | |
|---|---|---|---|---|
| 2007/0211006 | A1 | 9/2007 | Lee et al. | |
| 2010/0033413 | A1* | 2/2010 | Song | G09G 3/3655 345/89 |
| 2016/0343340 | A1* | 11/2016 | Zheng | G09G 3/3648 |

FOREIGN PATENT DOCUMENTS

| | | | |
|---|---|---|---|
| CN | 101645244 | A | 2/2010 |
| CN | 101937634 | A | 1/2011 |

(Continued)

OTHER PUBLICATIONS

First Chinese Office Action dated Nov. 28, 2016; Appln. No. 201510319899.8.

(Continued)

*Primary Examiner* — William Boddie
*Assistant Examiner* — Saifeldin E Elnafia

(57) ABSTRACT

A regulating method and a regulating apparatus for a driving voltage of a display module, wherein the method comprises: applying, to the display module, a gamma voltage pair corresponding to a grayscale to be tested, selecting a test image and maintaining the test image for a predetermined time duration (11); switching to a predetermined grayscale image that matches the grayscale to be tested, regulating a common voltage of the display module, and recording a direction and a magnitude of regulation of the common voltage (12); and restoring the common voltage to a mag- (Continued)

nitude before the regulation, and regulating the first gamma voltage and the second gamma voltage according to the recorded direction and magnitude of regulation of the common voltage (13). Regulation accuracy of the driving voltage can be improved, workload for debugging can be reduced and work efficiency can be improved.

14 Claims, 6 Drawing Sheets

(56) References Cited

FOREIGN PATENT DOCUMENTS

| | | | |
|---|---|---|---|
| CN | 103325357 | A | 9/2013 |
| CN | 103810963 | A | 5/2014 |
| KR | 1020070056405 | A | 6/2007 |

OTHER PUBLICATIONS

The Second Chinese Office Action dated May 11, 2017; Appln. No. 201510319899.8.

* cited by examiner

REGULATING METHOD AND REGULATING APPARATUS FOR A DRIVING VOLTAGE OF A DISPLAY MODULE

TECHNICAL FIELD

The present disclosure relates to a regulating method and a regulating apparatus for a driving voltage of a display module.

BACKGROUND

Liquid Crystal Display (LCD) has advantages of lightness and thinness, low power consumption and low heat etc., so that LCD outstands among many different types of display devices, and has been widely applied to modern information devices such as television, computer, tablet computer, mobile phone etc.

Residual image is one of the main problems that affect display quality of a liquid crystal panel. The residual image may be divided into AC residual image and DC residual image according to principles of occurrence of the residual image.

The AC residual image is usually generated because that under long-term action of an AC electric field, molecules on a surface of an alignment film suffer rheological relaxation, which results in that alignment of the alignment film varies slightly and cannot fully restore to the original state, thereby causing occurrence of the residual image. Such residual image is permanent. That is, once generated, the residual image will not disappear. As to the AC residual image, improvement can usually be made only from properties of the alignment film per se, to improve alignment ability of the alignment film.

Generally, the following are considered as two main factors for generation of the DC residual image: one is the existence of impurity ions inside the liquid crystal panel, the other is the existence of a DC bias voltage during driving the liquid crystal panel. Because of the two factors, when the liquid crystal panel displays the same image for a long term, impurity ions inside the LCD panel experience a directional movement under the action of the DC bias voltage, and accumulate at an interface between the alignment film and the liquid crystal on the surfaces of positive and negative electrodes, whereby a DC residual voltage is generated in the liquid crystal panel. When the DC residual voltage is sufficient to drive the liquid crystal molecules to change, it will affect a voltage actually applied across two sides of a liquid crystal layer, eventually leading to an occurrence of the residual image. Since the DC residual image is generated because impurity ions accumulate at the alignment film under the action of the DC bias voltage, the impurity ions will be desorbed from the surface of the alignment film when the DC bias voltage is removed. Therefore, the DC residual image may be restored.

At present, as to a small-sized liquid crystal panel, the DC residual image is the main type of residual image. In order to make improvement with respect to the DC residual image, there are usually several ways provided below. One is to minimize a content percentage of the impurity ions inside the liquid crystal panel as much as possible. This method mainly is implemented by developing liquid crystal and alignment film materials with fewer impurities and reducing introduced impurity ions during manufacturing process. Another one is to minimize the DC bias voltage as much as possible. Reducing the DC bias voltage may be implemented by design of the liquid crystal panel, for example, by increasing storage capacitance of pixels, reducing a TFT leakage current and so on. Also, The DC bias voltage may be reduced by optimizing the liquid crystal materials and the alignment film materials, or by circuit driving regulation.

As to the method of reducing concentration of impurity ions, since the concentration of impurity ions contained in the alignment film and the liquid crystal is quite low at present, it is very difficult to further reduce the concentration of impurity ions. Moreover, although optimization control can be performed on the impurity ions introduced in the manufacturing process, it is impossible to completely eliminate the impurity ions during the manufacturing process. Thus, at present, the DC residual image is improved mainly by reducing the DC bias voltage. However, due to limitations of pixel design and display substrate manufacturing, it is impossible to completely avoid the DC residual image. In addition, the method of optimizing materials can effectively reduce the DC residual image. However, a development cycle for a material is very long, and match testing is required for different liquid crystals and alignment films. The cycles for both development and testing are long. Therefore, circuit driving regulation is an efficient and simple method for reducing the DC bias voltage.

At present, when a method of asymmetric voltage regulation is adopted to reduce the DC bias voltage, regulation steps mainly comprise: first, setting initial values for a first gamma voltage and a second gamma voltage according to a V-T (i.e., driving voltage vs. transmittance) curve; then, in each grayscale, minimizing flicker in respective grayscale by regulating the second gamma voltage; and finally, adopting the method of shifting the first gamma voltage and the second gamma voltage integrally to make a regulated gamma curve match a standard gamma curve. This asymmetric gamma voltage regulation method is on a basis that a flicker degree in each grayscale is the minimum. However, in practice, since a flicker degree in a pure grayscale is extremely low, an extremely accurate measurement device is required to perform an accurate measurement; in addition, under a continuous action of light irradiation, prosperities of the liquid crystal and the alignment film suffer slight changes, and the flicker degree will also change as time. Therefore, it is not easy to accurately measure the flicker degree. In addition, this method is restricted by the manufacturing process. The flicker degrees at different locations inside the liquid crystal panel are different, and a location of performing flicker measurement has great affect on regulation of the first gamma voltage and the second gamma voltage. Accordingly, although the residual image can be reduced by regulating an asymmetric gamma voltage through a method of reducing the flicker degree by regulating the driving voltage, because of the existing of the above defects, it is hard to ensure regulation accuracy for the asymmetric driving voltage.

SUMMARY

Embodiments of the present application provide a regulating method and a regulating apparatus for a driving voltage of a display module, so as to improve regulation accuracy of the driving voltage, by which workloads for debugging can be reduced and work efficiency can be improved.

An embodiment of the present application provides a regulating method for a driving voltage of a display module, comprising:

applying, to the display module, a gamma voltage pair corresponding to a grayscale to be tested, selecting a test image and maintaining the test image for a predetermined time duration, the gamma voltage pair including a first gamma voltage and a second gamma voltage;

switching to a predetermined grayscale image that matches the grayscale to be tested, regulating a common voltage of the display module so that a retention level of a residual image generated by the test image meets set requirements, and recording a direction and a magnitude of regulation of the common voltage; and restoring the common voltage to a magnitude before the regulation, regulating the first gamma voltage and the second gamma voltage according to the recorded direction and magnitude of regulation of the common voltage, so that a retention level of a residual image of the display module as being driven by the regulated first gamma voltage and the regulated second gamma voltage meets the set requirements.

In the method provided by the embodiment of the present disclosure, first, a common voltage of the display module is regulated so that a retention level of a residual image generated by the test image meets set requirements, and a direction and a magnitude of regulation of the common voltage are recorded so as to determine a magnitude of the DC bias voltage; then, the common voltage is restored to a magnitude before the regulation, and the first gamma voltage and the second gamma voltage are regulated according to the recorded direction and magnitude of regulation of the common voltage, so that a retention level of a residual image of the display module as being driven by the regulated first gamma voltage and the regulated second gamma voltage meets the set requirements, thus implementing regulation to the asymmetric driving voltage. By the method provided by the embodiment of the present disclosure, a test driving voltage during the debugging can be regulated more accurately and more efficiently, and a regulated driving voltage of the display module can be acquired; meanwhile, it is also possible to implement entirely with software and hardware, to realize intelligence of regulation of the driving voltage, to reduce workload for debugging, to improve work efficiency and to avoid the interference caused by man-introduced factors.

Optionally, prior to regulating the common voltage of the display component, the method further comprising:

measuring a first luminance at a different location, and determining a type of a residual image generated by the test image and a retention level of the residual image according to the first luminance.

By measuring a first luminance at a different location and determining a type of a residual image generated by the test image and a retention level of the residual image according to the first luminance, it can be determined according to the type and the retention level in a subsequent regulation process whether the direction of the regulation is correct.

Optionally, the method may further comprise:

regulating the common voltage of the display module, to weaken the retention level of the residual image;

measuring a second luminance at a different location, and determining the retention level of the residual image according to the second luminance;

determining whether the retention level of the residual image meets the set requirements; and recording a direction and a magnitude of regulation of the common voltage if the retention level of the residual image meets the set requirements; otherwise, continuing to regulate the common voltage.

In the above process of regulating the common voltage, by measuring a second luminance at a different location and determining the retention level of the residual image according to the second luminance, and by determining whether the retention level of the residual image meets the set requirements, a magnitude and a direction of regulation of the common voltage can be determined, and directions and voltage offsets required to regulate the first driving voltage and the second driving voltage can be determined.

In addition, the method may further comprises:

determining a voltage offset required for the first gamma voltage and a voltage offset required for the second gamma voltage according to the direction and the magnitude of regulation of the common voltage;

regulating the first gamma voltage and the second gamma voltage in the same direction and with the same amplitude according to the direction of regulation of the common voltage and the required voltage offsets, to obtain a first gamma voltage to be tested and a second gamma voltage to be tested;

applying, to the display module, the first gamma voltage to be tested and the second gamma voltage to be tested, and again switching to the test image and maintaining the test image for the predetermined time duration;

switching to a predetermined grayscale image that matches the grayscale to be tested, measuring a third luminance at a different location, and determining a type of the residual image generated by the test image and a retention level of the residual image according to the third luminance;

determining whether the retention level of the residual image meets the set requirements; and when the retention level of the residual image meets the set requirements, determining the first gamma voltage to be tested and the second gamma voltage to be tested as a regulated first gamma voltage and a regulated second gamma voltage of the display module.

In the above processing of regulating the first driving voltage and the second driving voltage, a voltage offset required for the first gamma voltage and a voltage offset required for the second gamma voltage are determined according to the direction and the magnitude of regulation of the common voltage. Thereafter, the first gamma voltage and the second gamma voltage are regulated in the same direction and with the same amplitude to obtain a first gamma voltage to be tested and a second gamma voltage to be tested, so that the retention level of the residual image as being driven by the regulated first driving voltage and the regulated second driving voltage meets the set requirements, and an actual driving voltage required by the display module can be determined, thereby implementing regulation to the asymmetric driving voltage.

Optionally, the method further comprises:

when the retention level of the residual image does not meet the set requirements, determining whether the type of the residual image is consistent with that of an initial residual image, according to the type of the residual image generated when applying, to the display module, the first gamma voltage to be tested and the second gamma voltage to be tested;

if consistent, continuing to regulate the common voltage in the same direction so that the retention level of the residual image meets the set requirements; if not consistent, regulating the common voltage in an inverse direction so that the retention level of the residual image meets the set requirements.

By determining the type of the residual image, it can be determined whether an amount of regulation of the common voltage is too large or too small. When the type of the residual image is consistent with that of an initial residual image, it shows that the amount of regulation of the common voltage is not enough, and it needs to continue regulating the common voltage in the same direction so that the retention level of the residual image meets the set requirements; if the type of the residual image is not consistent with that of an initial residual image, it shows that the amount of regulation of the common voltage is too large, and it needs to regulate the common voltage in a reverse direction so that the retention level of the residual image meets the set requirements.

When the display module is in a normally black display mode, the grayscale to be tested can be set as L255, and the predetermined grayscale image that matches the grayscale to be tested can be set as a middle-to-low grayscale image; when the display component is in a normally white display mode, the grayscale to be tested can be set as L0, and the predetermined grayscale image that matches the grayscale to be tested can be set as a middle-to-high grayscale image.

When the display module is in a normally black display mode, the driving voltage applied when the grayscale is L255 is the maximum, and the luminance is the maximum, and the generated DC bias voltage is the maximum; whereas when the display component is in a normally white display mode, the driving voltage applied when the grayscale is L0 is the maximum, and the luminance is the maximum, and the generated DC bias voltage is the maximum. By regulating the first driving voltage and the second driving voltage in the case where the DC bias voltage is the maximum, it can reduce the retention level of the residual image effectively. In addition, the residual image is more easily observable in the grayscale image with a relatively low luminance. Thus, the predetermined grayscale image that matches the grayscale to be tested may be set as a grayscale image with a relatively low luminance. For example, the predetermined grayscale image that matches the grayscale to be tested can be set as a middle-to-low grayscale image when the display module is in a normally black display mode, and the predetermined grayscale image that matches the grayscale to be tested can be set as a middle-to-high grayscale image when the display component is in a normally white display mode.

Optionally, the test image can be a predetermined black-and-white checkerboard image.

The black-and-white checkerboard image may be lightened and maintained for a predetermined time duration, and then switched to other grayscale images to observe. Because black-white area has a relatively large contrast, the residual image of the black-and-white checkerboard image is easier to observe.

A regulating apparatus for a driving voltage of a display module provided by an embodiment of the present disclosure comprises:

a display module configured to display a test image and a predetermined grayscale image that matches a grayscale to be tested;

a regulation module configured to regulate, after switching to the predetermined grayscale image that matches the grayscale to be tested, a common voltage of the display module so that a retention level of a residual image generated by the test image meets set requirements, and to record a direction and a magnitude of regulation of the common voltage, and configured to restore the common voltage to a magnitude before the regulation, and to regulate the first gamma voltage and the second gamma voltage according to the recorded direction and magnitude of regulation of the common voltage, so that a retention level of a residual image of the display module as being driven by the regulated first gamma voltage and the regulated second gamma voltage meets the set requirements; and a driving module configured to apply, to the display module, a gamma voltage pair corresponding to the grayscale to be tested so that the display module displays the test image and maintains the test image for a predetermined time duration, the gamma voltage pair including a first gamma voltage and a second gamma voltage.

In the apparatus provided by the embodiment of the present disclosure, a common voltage of the display module is regulated so that a retention level of a residual image generated by the test image meets set requirements, and a direction and a magnitude of regulation of the common voltage are recorded so as to determine a magnitude of the DC bias voltage; then, the common voltage is restored to a magnitude before the regulation, and the first gamma voltage and the second gamma voltage are regulated according to the recorded direction and magnitude of regulation of the common voltage, so that a retention level of a residual image of the display module as being driven by the regulated first gamma voltage and the regulated second gamma voltage meets the set requirements, thus implementing regulation to the asymmetric driving voltage. By the apparatus provided by the embodiment of the present disclosure, a test driving voltage during the debugging can be regulated more accurately and more efficiently, and a regulated driving voltage of the display module can be acquired, meanwhile, it is also possible to implement entirely with software and hardware, to realize intelligence of regulation of the driving voltage, to reduce workload for debugging, to improve work efficiency and to avoid the interference caused by man-introduced factors, increase the debugging accuracy.

Optionally, the apparatus further comprises:

a luminance measuring module configured to measure a first luminance at a different location prior to regulating the common voltage of the display component, to measure a second luminance at a different location after regulating the common voltage, and to measure a third luminance at a different location after regulating the first gamma voltage and the second gamma voltage;

a data processing module configured to determine a type and a retention level of the residual image prior to regulating the common voltage according to the first luminance, to determine a type and a retention level of the residual image after regulating the common voltage according to the second luminance, and to determine a type and a retention level of the residual image generated as being driven by the regulated first gamma voltage and the regulated second gamma voltage according to the third luminance; and a determining module configured to determine whether the retention level of the residual image after regulating the common voltage meets the set requirements, and to determine whether the retention level of the residual image as being driven by the regulated first gamma voltage and the regulated second gamma voltage meets the set requirements.

In the embodiment of the present disclosure, prior to regulating the common voltage of the display module, the luminance measuring module measures a first luminance at a different location, then the data processing module determines a type and a retention level of the residual image prior to regulating the common voltage of the display module according to the first luminance, and thereby determines the direction of regulation of the common voltage; the luminance measuring module measures a second luminance at a different location after regulating the common voltage, then the data processing module determines a type and a retention level of the residual image after regulating the common voltage according to the second luminance, and the determining module determines whether the retention level of the residual image after regulating the common voltage meets the set requirements, and how to regulate the common voltage in the case of failing to meet the set requirements so that the retention level of the residual image meets the set requirements; the luminance measuring module measures a third luminance at a different location after regulating the first gamma voltage and the second gamma voltage, the data processing module determines a type and a retention level of the residual image as being driven by the regulated first gamma voltage and the regulated second gamma voltage according to the third luminance, and the determining module determines whether the retention level of the residual image as being driven by the regulated first gamma voltage and the regulated second gamma voltage meets the set requirements, so as to determine the first gamma voltage and the second gamma voltage required for driving the display module.

Optionally, in the apparatus:

the common voltage of the display module is regulated to weaken the retention level of the residual image;

a second luminance at a different location is measured, and the retention level of the residual image is determined according to the second luminance;

it is determined whether the retention level of the residual image meets the set requirements; and a direction and a magnitude of regulation of the common voltage are recorded if the retention level of the residual image meets the set requirements; otherwise, the common voltage is continually regulated.

In the above process of regulating the common voltage, by measuring a second luminance at a different location and determining the retention level of the residual image according to the second luminance, and determining whether the retention level of the residual image meets the set requirements, a magnitude and a direction of regulation of the common voltage can be determined, and directions and voltage offsets required to regulate the first driving voltage and the second driving voltage can be determined.

Optionally, in the apparatus:

a voltage offset required for the first gamma voltage and a voltage offset required for the second gamma voltage are determined according to the direction and the magnitude of regulation of the common voltage;

the first gamma voltage and the second gamma voltage are regulated in the same direction and with the same amplitude according to the direction of regulation of the common voltage and the required voltage offsets, to obtain a first gamma voltage to be tested and a second gamma voltage to be tested;

the first gamma voltage to be tested and the second gamma voltage to be tested are applied to the display module, and the test image is again switched to and maintained for a predetermined time duration;

a predetermined grayscale image that matches the grayscale to be tested is switched to, a third luminance at a different location is measured, and a type of the residual image generated by the test image and a retention level of the residual image are determined according to the third luminance;

it is determined whether the retention level of the residual image meets the set requirements; and when the retention level of the residual image meets the set requirements, the first gamma voltage to be tested and the second gamma voltage to be tested are determined as a regulated first gamma voltage and a regulated second gamma voltage of the display module.

In the above processing of regulating the first driving voltage and the second driving voltage, a voltage offset required for the first gamma voltage and a voltage offset required for the second gamma voltage are determined according to the direction and the magnitude of regulation of the common voltage. Thereafter, the first gamma voltage and the second gamma voltage are regulated in the same direction and with the same amplitude to obtain a first gamma voltage to be tested and a second gamma voltage to be tested, so that the retention level of the residual image as being driven by the regulated first driving voltage and the regulated second driving voltage meets the set requirements, and an actual driving voltage required by the display module can be determined, thereby implementing regulation to the asymmetric driving voltage.

Optionally, when the display module is in a normally black display mode, the grayscale to be tested can be set as L255, and the predetermined grayscale image that matches the grayscale to be tested can be set as a middle-to-low grayscale image; when the display component is in a normally white display mode, and the grayscale to be tested can be set as L0, the predetermined grayscale image that matches the grayscale to be tested can be set as a middle-to-high grayscale image.

When the display module is in a normally black display mode, the driving voltage applied when the grayscale is L255 is the maximum, and the luminance is the maximum, and the generated DC bias voltage is the maximum; when the display component is in a normally white display mode, the driving voltage applied when the grayscale is L0 is the maximum, and the luminance is the maximum, and the generated DC bias voltage is the maximum. By regulating the first driving voltage and the second driving voltage in the case where the DC bias voltage is the maximum, it can reduce the retention level of the residual image effectively. In addition, the residual image is more easily observable in the grayscale image with a relatively low luminance. Thus, the predetermined grayscale image that matches the grayscale to be tested may be set as a grayscale image with a relatively low luminance. For example, the predetermined grayscale image that matches the grayscale to be tested can be set as a middle-to-low grayscale image when the display module is in a normally black display mode, and the predetermined grayscale image that matches the grayscale to be tested can be set as a middle-to-high grayscale image when the display component is in a normally white display mode.

Optionally, the residual image includes a positive residual image and a negative residual image.

By determining the positive residual image and the negative residual image, it is possible to determine whether the common voltage is regulated too much, and further to ensure that the common voltage is regulated towards a right direction.

Optionally, the test image is a predetermined black-and-white checkerboard image.

The black-and-white checkerboard image may be lightened and maintained for a predetermined time duration, and then switched to other grayscale images to observe. Because black-white area has a relatively large contrast, the residual image of the black-and-white checkerboard image is easier to observe.

DETAILED DESCRIPTION OF THE EMBODIMENTS

Hereinafter, the technical solutions provided by the embodiments of the present disclosure will be described clearly and comprehensively in combination with the drawings. Obviously, these described embodiments are parts of the embodiments of the present disclosure, rather than all of the embodiments thereof.

Figure 1:
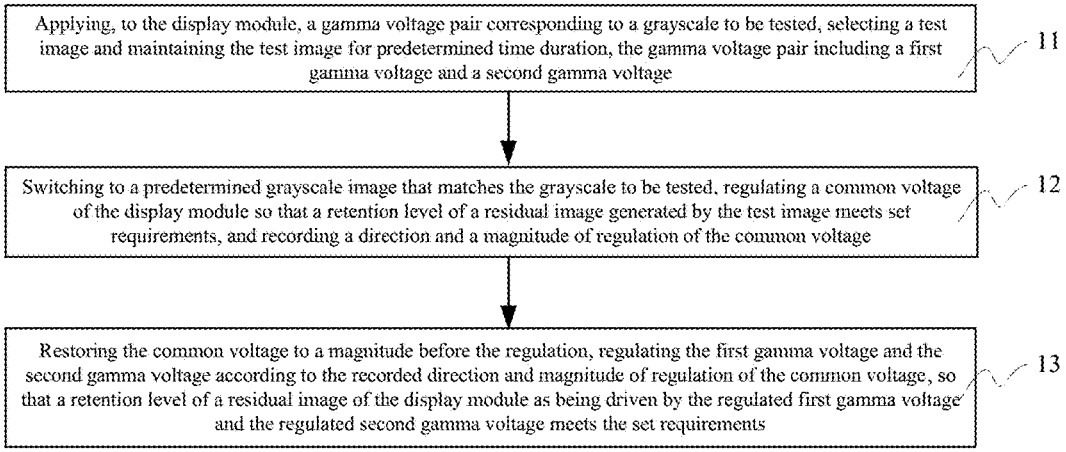
FIG. 1 is a schematic diagram of flows of a regulating method for a driving voltage of a display module provided by an embodiment of present disclosure.

FIG. 1 shows a regulating method for a driving voltage of a display module provided by an embodiment of present disclosure. Referring to FIG. 1, at step 11, a gamma voltage pair corresponding to a grayscale to be tested is applied to the display module, and a test image is selected and maintained for a predetermined time duration, the gamma voltage pair including a first gamma voltage and a second gamma voltage. At step 12, a predetermined grayscale image that matches the grayscale to be tested is switched to, a common voltage of the display module is regulated so that a retention level of a residual image generated by the test image meets set requirements, and a direction and a magnitude of regulation of the common voltage are recorded. At step 13, the common voltage is restored to a magnitude before the regulation, and the first gamma voltage and the second gamma voltage is regulated according to the recorded direction and magnitude of regulation of the common voltage, so that a retention level of a residual image of the display module as being driven by the regulated first gamma voltage and the regulated second gamma voltage meets the set requirements.

In the method provided by the embodiment of the present disclosure, a common voltage of the display module is regulated so that a retention level of a residual image generated by the test image meets set requirements, and a direction and a magnitude of regulation of the common voltage are recorded so as to determine a magnitude of the DC bias voltage; then, the common voltage is restored to a magnitude before the regulation, and the first gamma voltage and the second gamma voltage are regulated according to the recorded direction and magnitude of regulation of the common voltage, so that a retention level of a residual image of the display module as being driven by the regulated first gamma voltage and the regulated second gamma voltage meets the set requirements, thus implementing regulation to the asymmetric driving voltage. By the method provided by the embodiment of the present disclosure, a test driving voltage during the debugging can be regulated more accurately and more efficiently, and a regulated driving voltage of the display module can be acquired, meanwhile, it is also possible to implement entirely with software and hardware, to realize intelligence of regulation of the driving voltage, to reduce workload for debugging, to improve work efficiency and to avoid the interference caused by man-introduced factors.

In an embodiment, the method may comprise:

regulating the common voltage of the display module, to weaken the retention level of the residual image;

measuring a second luminance at a different location, and determining the retention level of the residual image according to the second luminance;

determining whether the retention level of the residual image meets the set requirements; and recording a direction and a magnitude of regulation of the common voltage if the retention level of the residual image meets the set requirements; otherwise, continuing to regulate the common voltage.

In the above process of regulating the common voltage, by measuring a second luminance at a different location and determining the retention level of the residual image according to the second luminance, and by determining whether the retention level of the residual image meets the set requirements, a magnitude and a direction of regulation of the common voltage can be determined, and directions and voltage offsets required to regulate the first driving voltage and the second driving voltage can be determined.

In addition, the method may further comprises:

determining a voltage offset required for the first gamma voltage and a voltage offset required for the second gamma voltage according to the direction and the magnitude of regulation of the common voltage;

regulating the first gamma voltage and the second gamma voltage in the same direction and with the same amplitude according to the direction of regulation of the common voltage and the required voltage offsets, to obtain a first gamma voltage to be tested and a second gamma voltage to be tested;

applying, to the display module, the first gamma voltage to be tested and the second gamma voltage to be tested, and again switching to the test image and maintaining the test image for the predetermined time duration;

switching to a predetermined grayscale image that matches the grayscale to be tested, measuring a third luminance at a different location, and determining a type of the residual image generated by the test image and a retention level of the residual image according to the third luminance;

determining whether the retention level of the residual image meets the set requirements; and when the retention level of the residual image meets the set requirements, determining the first gamma voltage to be tested and the second gamma voltage to be tested as a regulated first gamma voltage and a regulated second gamma voltage of the display module.

In the above processing of regulating the first driving voltage and the second driving voltage, a voltage offset required for the first gamma voltage and a voltage offset required for the second gamma voltage are determined according to the direction and the magnitude of regulation of the common voltage. Thereafter, the first gamma voltage and the second gamma voltage are regulated in the same direction and with the same amplitude to obtain a first gamma voltage to be tested and a second gamma voltage to be tested, so that the retention level of the residual image as being driven by the regulated first driving voltage and the regulated second driving voltage meets the set requirements, and an actual driving voltage required by the display module can be determined, thereby implementing regulation to the asymmetric driving voltage.

In an embodiment of the present disclosure, the required voltage offsets may be set as one-fifth of the magnitude of the regulation of the common voltage, or may be set as actually needed.

In addition, it may be determined, after each regulation, whether a retention level of a residual image generated by the display module as being driven by the regulated first gamma voltage and the regulated second gamma voltage meets the set requirements, so as to improve accuracy of the regulation.

Further, when the retention level of the residual image does not meet the set requirements, it can be determined whether the type of the residual image is consistent with that of an initial residual image, according to the type of the residual image generated when applying, to the display module, the first gamma voltage to be tested and the second gamma voltage to be tested; if consistent, the common voltage is continually regulated in the same direction so that the retention level of the residual image meets the set requirements; if not consistent, the common voltage is regulated in an inverse direction so that the retention level of the residual image meets the set requirements.

By determining the type of the residual image, it can be determined whether an amount of regulation of the common voltage is too large or too small. When the type of the residual image is consistent with that of an initial residual image, it shows that the amount of regulation of the common voltage is not enough, and it needs to continue regulating the common voltage in the same direction so that the retention level of the residual image meets the set requirements; if the type of the residual image is not consistent with that of an initial residual image, it shows that the amount of regulation of the common voltage is too large, and it needs to regulate the common voltage in a reverse direction so that the retention level of the residual image meets the set requirements.

It is possible to determine the type and the retention level of the residual image according to luminance at a different location. In an embodiment, prior to regulating the common voltage of the display component, a first luminance at a different location is measured and a type of a residual image generated by the test image and a retention level of the residual image are determined according to the first luminance. By measuring a first luminance at a different location and determining a type of a residual image generated by the test image and a retention level of the residual image according to the first luminance, it can be determined according to the type and the retention level in a subsequent regulation process whether the direction of the regulation is correct.

Further, when the display module is in a normally black display mode, the grayscale to be tested can be set as L255, and the predetermined grayscale image that matches the grayscale to be tested can be set as a middle-to-low grayscale image. When the display component is in a normally white display mode, the grayscale to be tested can be set as L0, and the predetermined grayscale image that matches the grayscale to be tested can be set as a middle-to-high grayscale image.

When the display module is in a normally black display mode, the driving voltage applied when the grayscale is L255 is the maximum, and the luminance is the maximum, and the generated DC bias voltage is the maximum; whereas when the display component is in a normally white display mode, the driving voltage applied when the grayscale is L0 is the maximum, and the luminance is the maximum, and the generated DC bias voltage is the maximum. Therefore, by regulating the first driving voltage and the second driving voltage in the case where the DC bias voltage is the maximum, it can reduce the retention level of the residual image effectively.

In addition, the residual image is more easily observable in the grayscale image with a relatively low luminance. Thus, the predetermined grayscale image that matches the grayscale to be tested may be set as a grayscale image with a relatively low luminance. For example, when the display module is in a normally black display mode, the predetermined grayscale image that matches the grayscale to be tested is set as a middle-to-low grayscale image, such as L48, L72 and L104; and when the display component is in a normally white display mode, the predetermined grayscale image that matches the grayscale to be tested is set as a middle-to-high grayscale image.

Figure 2:
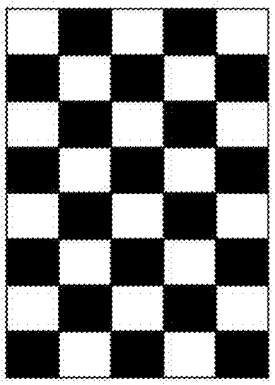
FIG. 2 is a schematic diagram of a test image of a black-and-white checkerboard image.

As shown in FIG. 2, the test image may be a predetermined black-and-white checkerboard image, wherein the black-and-white checkerboard image may be lightened and maintained for a predetermined time duration, and then switched to other grayscale images to observe. Because black-white area has a relatively large contrast, the residual image of the black-and-white checkerboard image is easier to observe.

Figure 2A:
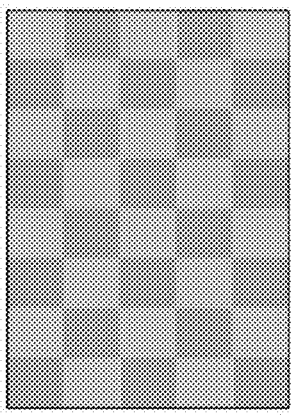
FIG. 2*a* is a schematic diagram of a positive residual image of a black-and-white checkerboard image.
Figure 2B:
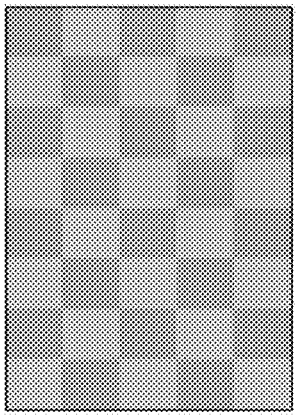
FIG. 2*b* is a schematic diagram of a negative residual image of a black-and-white checkerboard image.

Further, the residual image includes a positive residual image and a negative residual image, referring to FIGS. 2*a* and 2*b*. FIG. 2*a* is a schematic diagram of the positive residual image, and FIG. 2*b* is a schematic diagram of the negative residual image. The positive residual image refers to that a black area is blacker with respect to the other areas after being switched to a predetermined grayscale image that matches the grayscale to be tested, and a white area is whiter with respect to the other areas after being switched to a predetermined grayscale image that matches the grayscale to be tested. The negative residual image refers to that a black area is whiter with respect to the other areas after being switched to a predetermined grayscale image that matches the grayscale to be tested, and a white area is blacker with respect to the other areas after being switched to a predetermined grayscale image that matches the grayscale to be tested By determining the positive residual image and the negative residual image, it is possible to determine whether the common voltage is regulated too much, and in turn to ensure that the common voltage is regulated towards a right direction.

Figure 3:
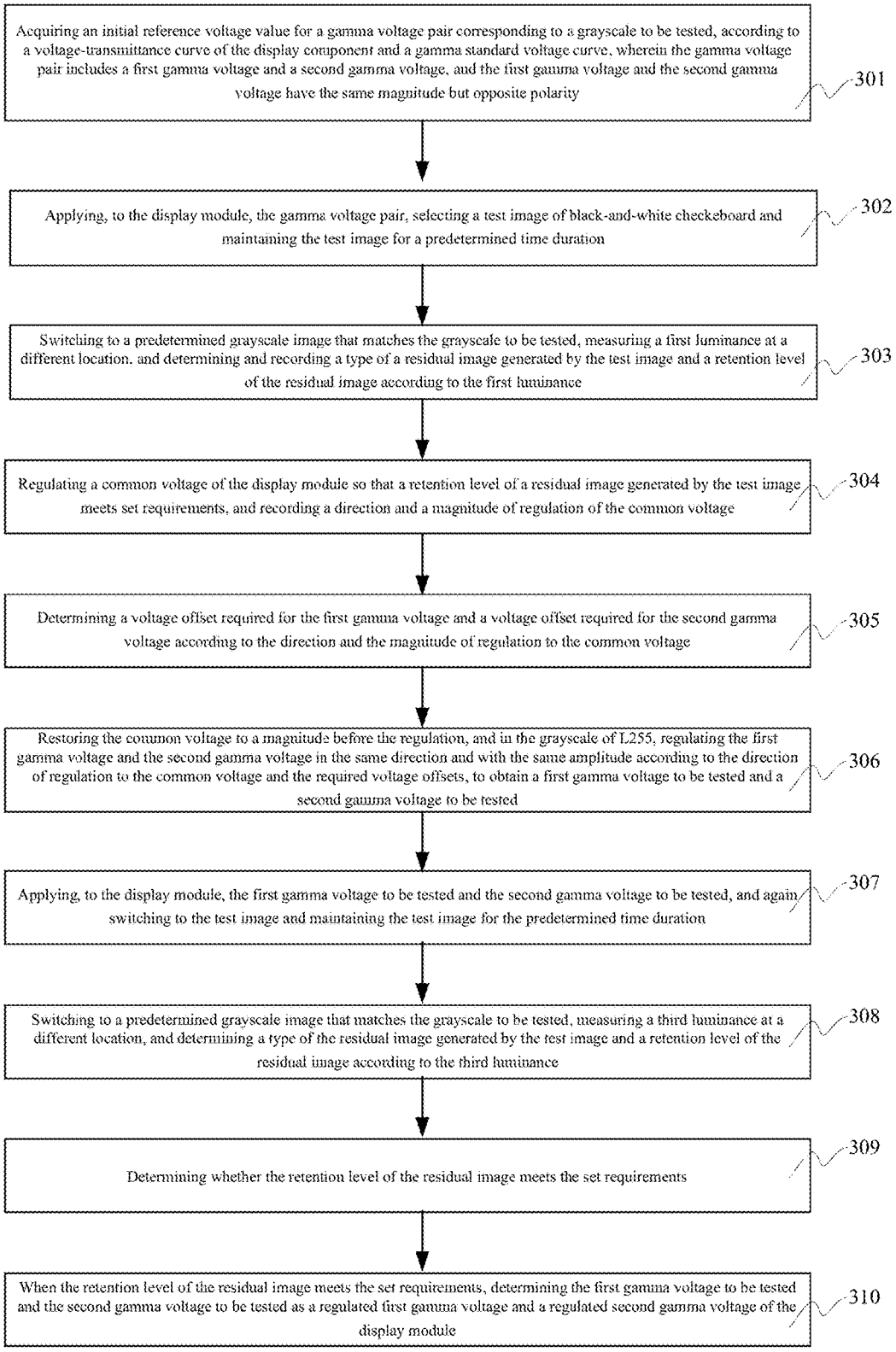
FIG. 3 is a schematic diagram of flows of a regulating method for a driving voltage of a display module provided by an embodiment of present disclosure.

FIG. 3 shows a regulating method for a driving voltage of a display module in a normally black display mode provided by an embodiment of present disclosure.

Figure 4:
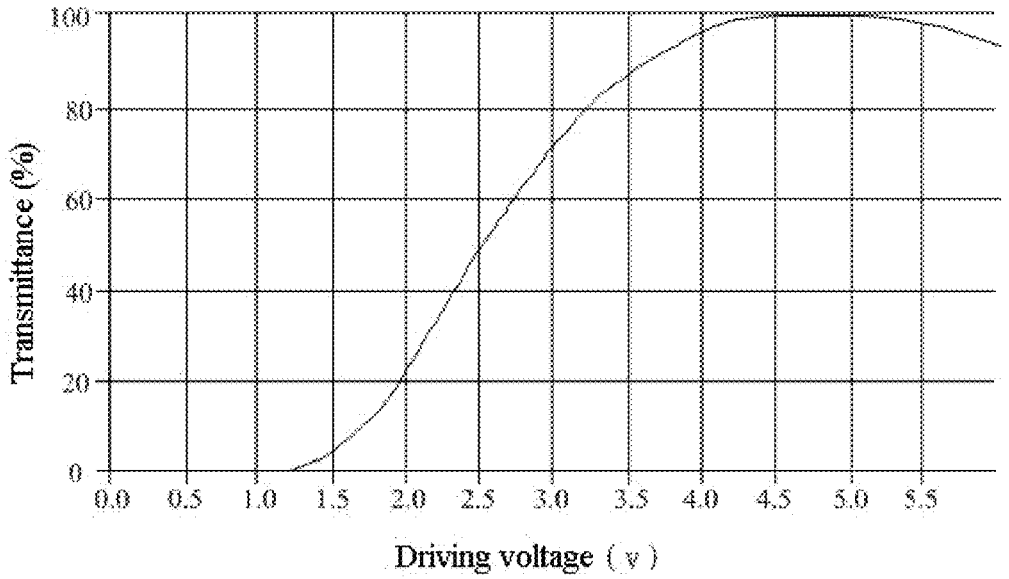
FIG. 4 is schematic diagram of a curve of relationship between driving voltage and transmittance in the display module.
Figure 5:
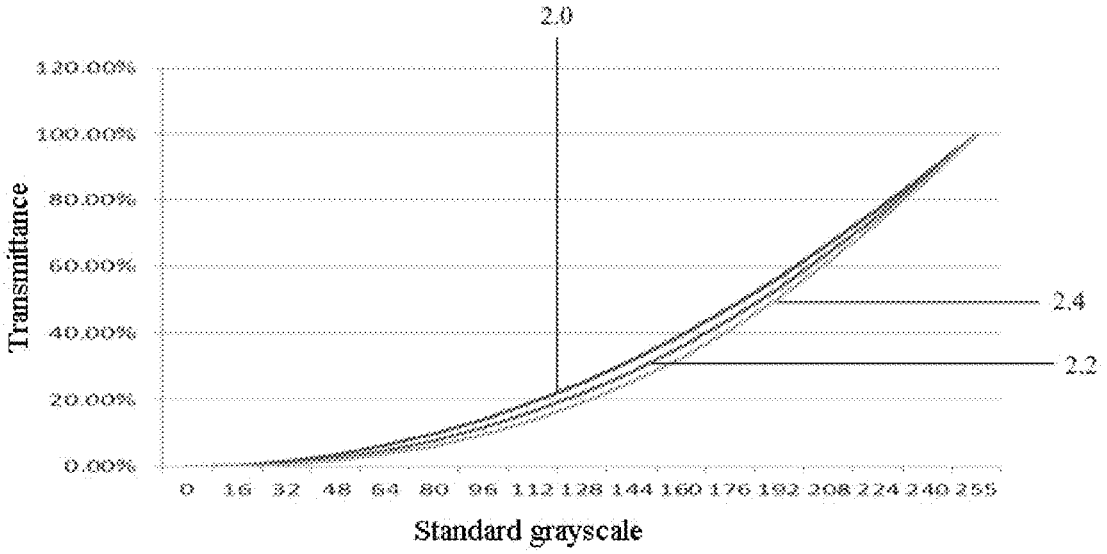
FIG. 5 is a schematic diagram of a standard curve of relationship between standard grayscale and transmittance.

At step 301, an initial reference voltage value for a gamma voltage pair corresponding to a grayscale to be tested is acquired according to a voltage-transmittance curve of the display component (referring to FIG. 4) and a gamma standard voltage curve (referring to FIG. 5), wherein the gamma voltage pair includes a first gamma voltage and a second gamma voltage, and the first gamma voltage and the second gamma voltage have the same magnitude but opposite polarity.

At step 302, the gamma voltage pair is applied to the display module, and a test image of black-and-white checkerboard is selected and maintained for a predetermined time duration. Usually, in order to ensure generation of a stable residual image, the predetermined time duration may be half an hour. The predetermined time duration may also be set as needed by the user.

At step 303, a predetermined grayscale image that matches the grayscale to be tested is switched to, a first luminance at a different location is measured, and a type of a residual image generated by the test image and a retention level of the residual image are determined and recorded according to the first luminance, wherein the predetermined grayscale image that matches the grayscale to be tested may be set as a middle-to-low grayscale image, such as L48, L72, L104, L112 etc.

At step 304, a common voltage of the display module is regulated so that a retention level of a residual image generated by the test image meets set requirements, and a direction and a magnitude of regulation of the common voltage are recorded. The common voltage of the display module can be regulated to weaken the retention level of the residual image. A second luminance at a different location can be measured, and the retention level of the residual image is determined according to the second luminance. It can be determined whether the retention level of the residual image meets the set requirements. If the retention level of the residual image meets the set requirements, a direction and a magnitude of regulation of the common voltage are recorded; otherwise, the common voltage is continuously regulated.

At step 305, a voltage offset required for the first gamma voltage and a voltage offset required for the second gamma voltage is determined according to the direction and the magnitude of regulation of the common voltage. Usually, the required voltage offsets may be set as one-fifth of the magnitude of the regulation of the common voltage. In addition, generally, when the common voltage is regulated towards a positive direction, the first gamma voltage and the second gamma voltage are also regulated towards the positive direction; and when the common voltage is regulated towards a negative direction, the first gamma voltage and the second gamma voltage are also regulated towards the negative direction.

At step 306, the common voltage is restored to a magnitude before the regulation, and in the grayscale of L255, the first gamma voltage and the second gamma voltage are regulated in the same direction and with the same amplitude according to the direction of regulation of the common voltage and the required voltage offsets, to obtain a first gamma voltage to be tested and a second gamma voltage to be tested.

At step 307, the first gamma voltage to be tested and the second gamma voltage to be tested are applied to the display module, and the test image is again switched to and maintained for the predetermined time duration.

At step 308, a predetermined grayscale image that matches the grayscale to be tested is switched to, a third luminance at a different location is measured, and a type of the residual image generated by the test image and a retention level of the residual image are determined according to the third luminance.

At step 309, it is determined whether the retention level of the residual image meets the set requirements.

At step 310, when the retention level of the residual image meets the set requirements, the first gamma voltage to be tested and the second gamma voltage to be tested are determined as a regulated first gamma voltage and a regulated second gamma voltage of the display module.

In addition, when the retention level of the residual image does not meet the set requirements, it can be determined whether the type of the residual image is consistent with that of an initial residual image, according to the type of the residual image generated when applying, to the display module, the first gamma voltage to be tested and the second gamma voltage to be tested. If consistent, the common voltage is continuously regulated in the same direction so that the retention level of the residual image meets the set requirements; if not consistent, the common voltage is regulated in an inverse direction so that the retention level of the residual image meets the set requirements. For example, when the type of the residual image is consistent with that before regulation, it shows that the amount of offset for a gamma voltage is not enough, and it needs to continue to increase the offsets for the first gamma voltage and the second gamma voltage; if the type of the residual image is opposite to that before regulation, it shows that the amount of offset for a gamma voltage is too large, and correspondingly, it needs to reduce the offsets for the first gamma voltage and the second gamma voltage.

The retention level of the residual image can be reduced by means of regulating the first gamma voltage and the second gamma voltage corresponding to the grayscale L255 or L0. However, it should be appreciated that the regulating method for a driving voltage provided by the embodiment of the present disclosure can be applied to regulation of the driving voltage in any grayscale.

Figure 6:
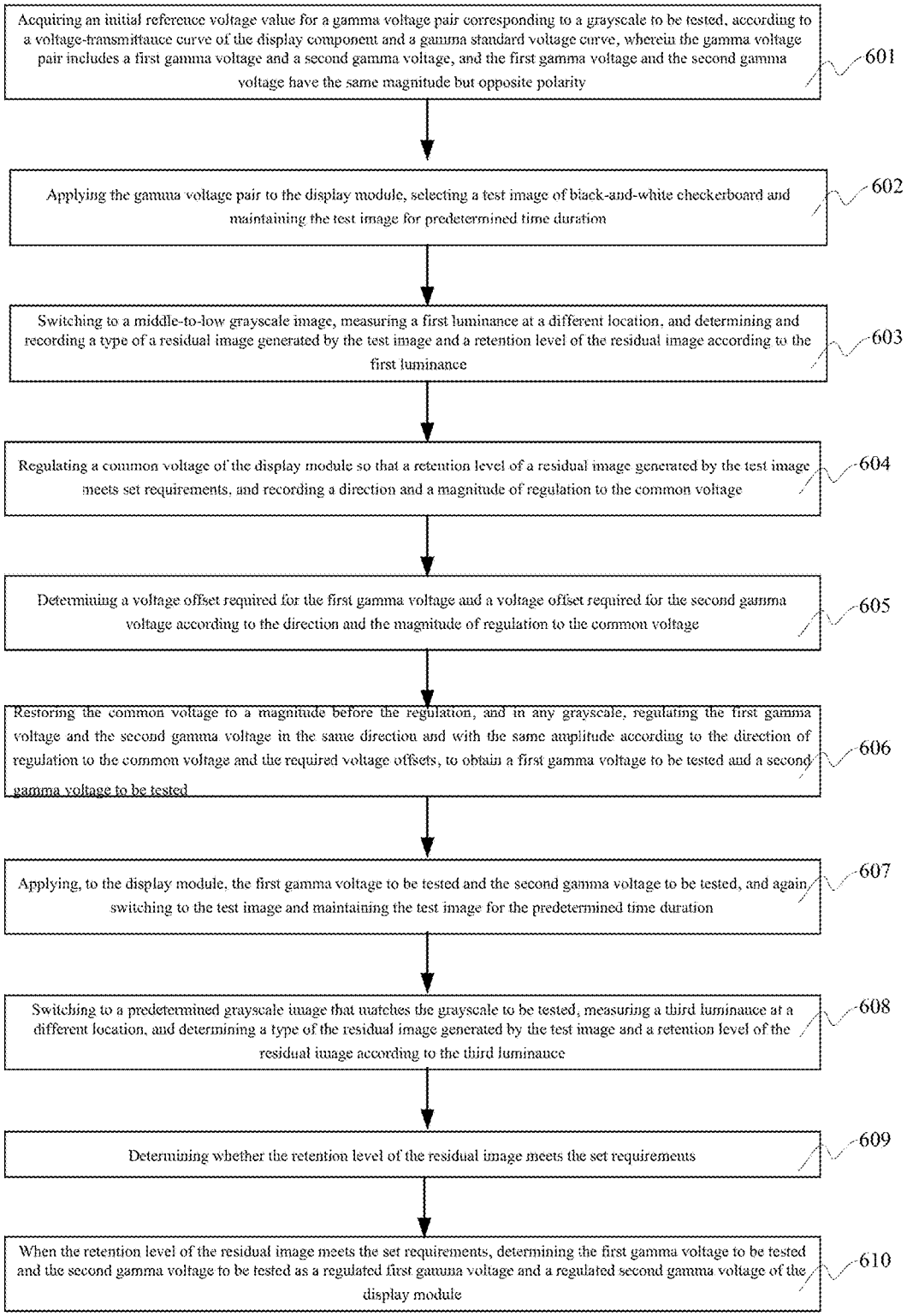
FIG. 6 is a schematic diagram of flows of a regulating method for a driving voltage of a display module provided by an embodiment of present disclosure.

As shown in FIG. 6, for any grayscale, at step 601, an initial reference voltage value for a gamma voltage pair corresponding to a grayscale to be tested is acquired according to a voltage-transmittance curve (i.e. V-T curve) of the display component and a gamma standard voltage curve, wherein the gamma voltage pair includes a first gamma voltage and a second gamma voltage, and the first gamma voltage and the second gamma voltage have the same magnitude but opposite polarity.

At step 602, the gamma voltage pair is applied to the display module, and a test image of black-and-white checkerboard is selected and maintained for a predetermined time duration.

At step 603, a middle-to-low grayscale image is switched to, a first luminance at a different location is measured, and a type of a residual image generated by the test image and a retention level of the residual image are determined and recorded according to the first luminance.

At step 604, a common voltage of the display module is regulated so that a retention level of a residual image generated by the test image meets set requirements, and a direction and a magnitude of regulation of the common voltage are recorded.

At step 605, a voltage offset required for the first gamma voltage and a voltage offset required for the second gamma voltage are determined according to the direction and the magnitude of regulation of the common voltage.

At step 606, the common voltage is restored to a magnitude before the regulation, and in any grayscale, the first gamma voltage and the second gamma voltage are regulated in the same direction and with the same amplitude, according to the direction of regulation of the common voltage and the required voltage offsets, to obtain a first gamma voltage to be tested and a second gamma voltage to be tested.

At step 607, the first gamma voltage to be tested and the second gamma voltage to be tested are applied to the display module, and the test image is again switched to and maintained for the predetermined time duration.

At step 608, a predetermined grayscale image that matches the grayscale to be tested is switched to, a third luminance at a different location is measured, and a type of the residual image generated by the test image and a retention level of the residual image are determined according to the third luminance.

At step 609, it is determined whether the retention level of the residual image meets the set requirements.

At step 610, when the retention level of the residual image meets the set requirements, the first gamma voltage to be tested and the second gamma voltage to be tested are determined as a regulated first gamma voltage and a regulated second gamma voltage of the display module.

Further, when the retention level of the residual image does not meet the set requirements, it can be determined whether the type of the residual image is consistent with that of an initial residual image, according to the type of the residual image generated when applying, to the display module, the first gamma voltage to be tested and the second gamma voltage to be tested. the common voltage is continuously regulated in the same direction so that the retention level of the residual image meets the set requirements; if not consistent, the common voltage is regulated in an inverse direction so that the retention level of the residual image meets the set requirements. For example, when the type of the residual image is consistent with that before regulation, it shows that the amount of offset for a gamma voltage is not enough, and it needs to continue to increase the offsets for the first gamma voltage and the second gamma voltage; if the type of the residual image is opposite to that before regulation, it shows that the amount of offset for a gamma voltage is too large, and correspondingly, it needs to reduce the offsets for the first gamma voltage and the second gamma voltage.

In addition, at the time of serious residual image due to a large DC bias voltage, the gamma voltage corresponding to L255/L0 may be regulated first, and then the gamma voltage corresponding to the required grayscale is regulated, so that asymmetric settings of the L255/L0 and each required grayscale can be small, so as to solve better the problems such as flicker display inequality caused by the relatively large DC bias voltage.

Figure 7:
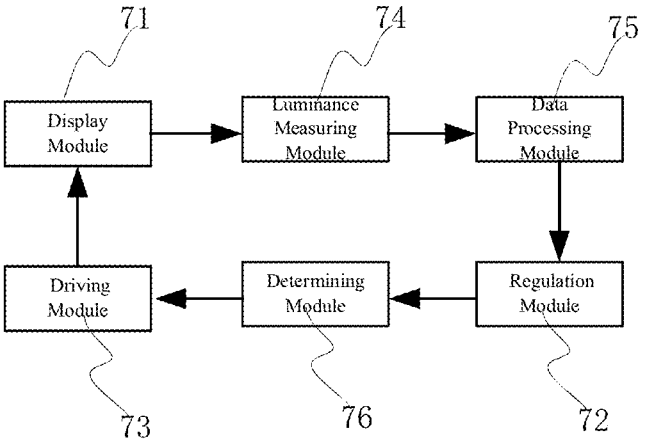
FIG. 7 is a schematic diagram of structure of an apparatus of regulating a driving voltage of a display module provided by an embodiment of present disclosure.

FIG. 7 shows a regulating apparatus for a driving voltage of a display module provided by an embodiment of present disclosure. The apparatus may comprise a display module 71, a regulation module 72, and a driving module 73. The display module 71 may display a test image and a predetermined grayscale image that matches a grayscale to be tested. The regulation module 72 may regulate a common voltage of the display module after switching to the predetermined grayscale image that matches the grayscale to be tested so that a retention level of a residual image generated by the test image meets set requirements, and may record a direction and a magnitude of regulation of the common voltage. The regulation module 72 may also restore the common voltage to a magnitude before the regulation, and may regulate the first gamma voltage and the second gamma voltage according to the recorded direction and magnitude of regulation of the common voltage, so that a retention level of a residual image of the display module as being driven by the regulated first gamma voltage and the regulated second gamma voltage meets the set requirements. The driving module 73 may apply, to the display module, a gamma voltage pair corresponding to the grayscale to be tested, so that the display module displays the test image and maintains the test image for a predetermined time duration, the gamma voltage pair including a first gamma voltage and a second gamma voltage.

In the apparatus provided by the embodiment of the present disclosure, a common voltage of the display module is regulated so that a retention level of a residual image generated by the test image meets set requirements, and a direction and a magnitude of regulation of the common voltage are recorded so as to determine a magnitude of the DC bias voltage; then, the common voltage is restored to a magnitude before the regulation, and the first gamma voltage and the second gamma voltage are regulated according to the recorded direction and magnitude of regulation of the common voltage, so that a retention level of a residual image of the display module as being driven by the regulated first gamma voltage and the regulated second gamma voltage meets the set requirements, thus implementing regulation to the asymmetric driving voltage. By the apparatus provided by the embodiment of the present disclosure, a test driving voltage during the debugging can be regulated more accurately and more efficiently, and a regulated driving voltage of the display module can be acquired, meanwhile, it is also possible to implement entirely with software and hardware, to realize intelligence of regulation of the driving voltage, to reduce workload for debugging, to improve work efficiency and to avoid the interference caused by man-introduced factors.

Further, in an embodiment, the apparatus may further comprise a luminance measuring module 74, a data processing module 75, and a determining module 76. The luminance measuring module 74 may measure a first luminance at a different location prior to regulating the common voltage of the display component, measure a second luminance at a different location after regulating the common voltage, and measure a third luminance at a different location after regulating the first gamma voltage and the second gamma voltage. The data processing module 75 may determine a type and a retention level of the residual image prior to regulating the common voltage of the display module, according to the first luminance, determine a type and a retention level of the residual image after regulating the common voltage according to the second luminance, and determine a type and a retention level of the residual image generated as being driven by the regulated first gamma voltage and the regulated second gamma voltage according to the third luminance. The determining module 76 may determine whether the retention level of the residual image after regulating the common voltage meets the set requirements, and determine whether the retention level of the residual image as being driven by the regulated first gamma voltage and the regulated second gamma voltage meets the set requirements.

In the embodiment of the present disclosure, prior to regulating the common voltage of the display module, the luminance measuring module measures a first luminance at a different location, then the data processing module determines a type and a retention level of the residual image prior to regulating the common voltage of the display module according to the first luminance, and in turn determines the direction of regulation of the common voltage; the luminance measuring module measures a second luminance at a different location after regulating the common voltage, then the data processing module determines a type and a retention level of the residual image after regulating the common voltage according to the second luminance, and the determining module determines whether the retention level of the residual image after regulating the common voltage meets the set requirements and how to regulate the common voltage in the case of failing to meet the set requirements so that the retention level of the residual image meets the set requirements; the luminance measuring module measures a third luminance at a different location after regulating the first gamma voltage and the second gamma voltage, the data processing module determines a type and a retention level of the residual image generated as being driven by the regulated first gamma voltage and the regulated second gamma voltage according to the third luminance, and the determining module determines whether the retention level of the residual image as being driven by the regulated first gamma voltage and the regulated second gamma voltage meets the set requirements, to determine the first gamma voltage and the second gamma voltage required for driving the display module.

In addition, in an embodiment, the common voltage of the display module may be regulated by the regulation module 72, to weaken the retention level of the residual image. Then, by the luminance measuring module 74, a second luminance at a different location is measured and the retention level of the residual image is determined according to the second luminance. Thereafter, it is determined by the determining module 76 whether the retention level of the residual image meets the set requirements. If the retention level of the residual image meets the set requirements, a direction and a magnitude of regulation of the common voltage are recorded; otherwise, it continues to regulate the common voltage.

In the above process of regulating the common voltage, by measuring a second luminance at a different location and determining the retention level of the residual image according to the second luminance, and by determining whether the retention level of the residual image meets the set requirements, a magnitude and a direction of regulation of the common voltage can be determined, and directions and voltage offsets required to regulate the first driving voltage and the second driving voltage can be determined.

In addition, in an embodiment, a voltage offset required for the first gamma voltage and a voltage offset required for the second gamma voltage may be determined according to the direction and the magnitude of regulation of the common voltage, wherein the required voltage offsets may be one-fifth of the magnitude of the regulation of the common voltage. Then, the regulation module 72 regulates the first gamma voltage and the second gamma voltage in the same direction and with the same amplitude according to the direction of regulation of the common voltage and the required voltage offsets, to obtain a first gamma voltage to be tested and a second gamma voltage to be tested. Thereafter, the driving module 73 applies, to the display module, the first gamma voltage to be tested and the second gamma voltage to be tested, and the test image is again switched to and maintained for the predetermined time duration. A predetermined grayscale image that matches the grayscale to be tested is switched to, and the luminance measuring module 74 a measures a third luminance at a different location and determines a type of the residual image generated by the test image and a retention level of the residual image according to the third luminance. The determining module 76 determines whether the retention level of the residual image meets the set requirements. When the retention level of the residual image meets the set requirements, the first gamma voltage to be tested and the second gamma voltage to be tested are determined as a regulated first gamma voltage and a regulated second gamma voltage of the display module.

In the above processing of regulating the first driving voltage and the second driving voltage, a voltage offset required for the first gamma voltage and a voltage offset required for the second gamma voltage are determined according to the direction and the magnitude of regulation of the common voltage. Usually, the required voltage offsets may be set as one-fifth of the magnitude of the regulation of the common voltage. Thereafter, the first gamma voltage and the second gamma voltage are regulated in the same direction and with the same amplitude to obtain a first gamma voltage to be tested and a second gamma voltage to be tested, so that the retention level of the residual image as being driven by the regulated first driving voltage and the regulated second driving voltage meets the set requirements, and an actual driving voltage required by the display module can be determined, thereby implementing regulation to the asymmetric driving voltage.

In an embodiment of the present disclosure, the required voltage offsets may be set as one-fifth of the magnitude of the regulation of the common voltage, or may be set as actually needed.

In order to improve accuracy of the regulation, it may be determined, after each regulation of the gamma voltage pair, whether a retention level of a residual image generated by the display module as being driven by the regulated first gamma voltage and the regulated second gamma voltage meets the set requirements.

When the retention level of the residual image does not meet the set requirements, the determining module 76 may determine whether the type of the residual image is consistent with that of an initial residual image, according to the type of the residual image generated when applying, to the display module, the first gamma voltage to be tested and the second gamma voltage to be tested. The regulation module 72 may continue to regulate the common voltage in the same direction when the type of the residual image is consistent with that of an initial residual image, so that the retention level of the residual image meets the set requirements; otherwise, regulate the common voltage in an inverse direction so that the retention level of the residual image meets the set requirements.

By determining the type of the residual image, it can be determined whether an amount of regulation of the common voltage is too large or too small. When the type of the residual image is consistent with that before regulation, it shows that the amount of offset for a gamma voltage is not enough, and it needs to continue to increase the offsets for the first gamma voltage and the second gamma voltage; if the type of the residual image is opposite to that before regulation, it shows that the amount of offset for a gamma voltage is too large, and correspondingly, it needs to reduce the offsets for the first gamma voltage and the second gamma voltage.

In addition, when the display module is in a normally black display mode, the grayscale to be tested may be set as L255, and the predetermined grayscale image that matches the grayscale to be tested may be set as a middle-to-low grayscale image; when the display component is in a normally white display mode, the grayscale to be tested may be set as L0, and the predetermined grayscale image that matches the grayscale to be tested may be set as a middle-to-high grayscale image.

When the display module is in a normally black display mode, the driving voltage applied when the grayscale is L255 is the maximum, and the luminance is the maximum, and the generated DC bias voltage is the maximum; whereas when the display component is in a normally white display mode, the driving voltage applied when the grayscale is L0 is the maximum, and the luminance is the maximum, and the generated DC bias voltage is the maximum. By regulating the first driving voltage and the second driving voltage in the case where the DC bias voltage is the maximum, it can reduce the retention level of the residual image effectively. In addition, the residual image is more easily observable in the grayscale image with a relatively low luminance. Thus, the predetermined grayscale image that matches the grayscale to be tested may be set as a grayscale image with a relatively low luminance. For example, the predetermined grayscale image that matches the grayscale to be tested is set as a middle-to-low grayscale image, such as L48, L72, L104, L112 etc., the predetermined grayscale image that matches the grayscale to be tested is set as a middle-to-high grayscale image.

Further, the test image can be a predetermined black-and-white checkerboard image.

The black-and-white checkerboard image may be lightened and maintained for a predetermined time duration, and then switched to other grayscale images to observe. Because black-white area has a relatively large contrast, the residual image of the black-and-white checkerboard image is easier to observe.

In addition, the residual image may include a positive residual image and a negative residual image. The positive residual image refers to that a black area is blacker with respect to the other areas after being switched to a predetermined grayscale image that matches the grayscale to be tested, and a white area is whiter with respect to the other areas after being switched to a predetermined grayscale image that matches the grayscale to be tested. The negative residual image refers to that a black area is whiter with respect to the other areas after being switched to a predetermined grayscale image that matches the grayscale to be tested, and a white area is blacker with respect to the other areas after being switched to a predetermined grayscale image that matches the grayscale to be tested.

By determining the positive residual image and the negative residual image, it is possible to determine whether the common voltage is regulated too much, and in turn ensure that the common voltage is regulated towards a right direction.

To sum up, in the method and apparatus provided by the embodiments of the present disclosure, a common voltage of the display module is regulated so that a retention level of a residual image generated by the test image meets set requirements, and a direction and a magnitude of regulation of the common voltage are recorded so as to determine a magnitude of the DC bias voltage; then, the common voltage is restored to a magnitude before the regulation, and the first gamma voltage and the second gamma voltage are regulated according to the recorded direction and magnitude of regulation of the common voltage, so that a retention level of a residual image of the display module as being driven by the regulated first gamma voltage and the regulated second gamma voltage meets the set requirements, thus implementing regulation to the asymmetric driving voltage. By the method and apparatus provided by the embodiments of the present disclosure, a test driving voltage during the debugging can be regulated more accurately and more efficiently, and a regulated driving voltage of the display module can be acquired, meanwhile, it is also possible to implement entirely with software and hardware, to realize intelligence of regulation of the driving voltage, to reduce workload for debugging, to improve work efficiency and to avoid the interference caused by man-introduced factors.

Obviously, those skilled in the art can make various modifications and variations to the present disclosure without departing from the spirit and scope thereof. The present disclosure is also intended to include these modifications and variations.

The present application claims priority of the Chinese Patent Application No. 201510319899.8 filed on Jun. 11, 2015, the entire disclosure of which is hereby incorporated in full text by reference as part of the present application.

What is claimed is:

1. A regulating method for a driving voltage of a display module, comprising:

applying, to the display module, a gamma voltage pair corresponding to a grayscale to be tested, selecting a test image and maintaining the test image for a predetermined time duration, the gamma voltage pair including a first gamma voltage and a second gamma voltage;

switching to a predetermined grayscale image that matches the grayscale to be tested, regulating a common voltage of the display module so that a retention level of a residual image generated by the test image meets set requirements, and recording a direction and a magnitude of regulation of the common voltage; and restoring the common voltage to a magnitude before the regulation, determining a voltage offset required for the first gamma voltage and a voltage offset required for the second gamma voltage according to the direction and the magnitude of regulation of the common voltage, regulating the first gamma voltage and the second gamma voltage in the same direction and with the same amplitude according to the direction of regulation of the common voltage and the required voltage offsets, to obtain a first gamma voltage to be tested and a second gamma voltage to be tested, applying, to the display module, the first gamma voltage to be tested and the second gamma voltage to be tested, so that a retention level of a residual image of the display module as being driven by the first gamma voltage to be tested and the second gamma voltage to be tested meets the set requirements.

2. The regulating method according to claim 1, further comprising:

prior to regulating the common voltage of the display component, measuring a first luminance at a different location, and determining a type of a residual image generated by the test image and a retention level of the residual image according to the first luminance.

3. The regulating method according to claim 1, further comprising:

regulating the common voltage of the display module, to weaken the retention level of the residual image;

measuring a second luminance at a different location, and determining the retention level of the residual image according to the second luminance;

determining whether the retention level of the residual image meets the set requirements; and recording a direction and a magnitude of regulation of the common voltage if the retention level of the residual image meets the set requirements; otherwise, continuing to regulate the common voltage.

4. The regulating method according to claim 1, further comprising:

again switching to the test image and maintaining the test image for the predetermined time duration;

switching to a predetermined grayscale image that matches the grayscale to be tested, measuring a third luminance at a different location, and determining a type of the residual image generated by the test image and a retention level of the residual image according to the third luminance;

determining whether the retention level of the residual image meets the set requirements; and when the retention level of the residual image meets the set requirements, determining the first gamma voltage to be tested and the second gamma voltage to be tested as a regulated first gamma voltage and a regulated second gamma voltage of the display module.

5. The regulating method according to claim 4, further comprising:

when the retention level of the residual image does not meet the set requirements, determining whether the type of the residual image is consistent with that of an initial residual image, according to the type of the residual image generated when applying, to the display module, the first gamma voltage to be tested and the second gamma voltage to be tested;

if consistent, continuing to regulate the common voltage in the same direction so that the retention level of the residual image meets the set requirements; if not consistent, regulating the common voltage in an inverse direction so that the retention level of the residual image meets the set requirements.

6. The regulating method according to claim 1, wherein when the display module is in a normally black display mode, the grayscale to be tested is set as L255, and the predetermined grayscale image that matches the grayscale to be tested is set as a middle-to-low grayscale image; when the display component is in a normally white display mode, the grayscale to be tested is set as L0, and the predetermined grayscale image that matches the grayscale to be tested is set as a middle-to-high grayscale image.

7. The regulating method according to claim 1, wherein the test image is a predetermined black-and-white checkerboard image.

8. A regulating apparatus for a driving voltage of a display module, comprising:

a display module configured to display a test image and a predetermined grayscale image that matches a grayscale to be tested;

a regulation module configured to regulate, after switching to the predetermined grayscale image that matches the grayscale to be tested, a common voltage of the display module so that a retention level of a residual image generated by the test image meets set requirements, and to record a direction and a magnitude of regulation of the common voltage, and configured to restore the common voltage to a magnitude before the regulation, and to determine a voltage offset required for the first gamma voltage and a voltage offset required for the seco gamma voltage according to the direction and the magnitude of regulation of the common voltage; regulate the first gamma voltage and the second gamma voltage in the same direction and with the sale amplitude according to the direction of regulation of the common voltage and the required voltage offsets, to obtain a first gamma voltage to be tested and a second gamma voltage to be tested, and configured to apply to the display module, the first gamma voltage to be tested and the second gamma voltage to be tested, so that a retention level of a residual image of the display module as being driven by the first gamma voltage to be tested and the second gamma voltage to be tested meets the set requirements; and a driving module configured to apply, to the display module, a gamma voltage pair corresponding to the grayscale to be tested so that the display module displays the test image and maintains the test image for a predetermined time duration, the gamma voltage pair including a first gamma voltage and a second gamma voltage.

9. The regulating apparatus according to claim 8, further comprising:

a luminance measuring module configured to measure a first luminance at a different location prior to regulating the common voltage of the display component, to measure a second luminance at a different location after regulating the common voltage, and to measure a third luminance at a different location after regulating the first gamma voltage and the second gamma voltage;

a data processing module configured to determine a type and a retention level of the residual image prior to regulating the common voltage according to the first luminance, to determine a type and a retention level of the residual image after regulating the common voltage according to the second luminance, and to determine a type and a retention level of the residual image generated as being driven by the regulated first gamma voltage and the regulated second gamma voltage according to the third luminance; and a determining module configured to determine whether the retention level of the residual image after regulating the common voltage meets the set requirements, and to determine whether the retention level of the residual image as being driven by the regulated first gamma voltage and the regulated second gamma voltage meets the set requirements.

10. The regulating apparatus according to claim 8, wherein the common voltage of the display module is regulated to weaken the retention level of the residual image;

a second luminance at a different location is measured, and the retention level of the residual image is determined according to the second luminance;

it is determined whether the retention level of the residual image meets the set requirements; and a direction and a magnitude of regulation of the common voltage are recorded if the retention level of the residual image meets the set requirements; otherwise, the common voltage is continually regulated.

11. The regulating apparatus according to claim 10, wherein the test image is again switched to and maintained for a predetermined time duration;

a predetermined grayscale image that matches the grayscale to be tested is switched to, a third luminance at a different location is measured, and a type of the residual image generated by the test image and a retention level of the residual image are determined according to the third luminance;

it is determined whether the retention level of the residual image meets the set requirements; and when the retention level of the residual image meets the set requirements, the first gamma voltage to be tested and the second gamma voltage to be tested are determined as a regulated first gamma voltage and a regulated second gamma voltage of the display module.

12. The regulating apparatus according to claim 8, wherein when the display module is in a normally black display mode, the grayscale to be tested is set as L255, and the predetermined grayscale image that matches the grayscale to be tested is set as a middle-to-low grayscale image; when the display component is in a normally white display mode, the grayscale to be tested is set as L0, and the predetermined grayscale image that matches the grayscale to be tested is set as a middle-to-high grayscale image.

13. The regulating apparatus according to claim 8, wherein the residual image includes a positive residual image and a negative residual image.

14. The regulating apparatus according to claim 8, wherein the test image is a predetermined black-and-white checkerboard image.

* * * * *